US010151006B2

(12) United States Patent
Yamahira et al.

(10) Patent No.: US 10,151,006 B2
(45) **Date of Patent: *Dec. 11, 2018**

(54) METHOD OF DETECTING ABNORMALITY AT BLAST FURNACE AND METHOD OF OPERATING BLAST FURNACE

(71) Applicant: JFE Steel Corporation, Tokyo (JP)

(72) Inventors: Naoshi Yamahira, Fukuyama (JP); Toshifumi Kodama, Kawasaki (JP); Yasuyuki Morikawa, Chiba (JP); Yusuke Tanaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/896,805

(22) PCT Filed: Jun. 13, 2014

(86) PCT No.: PCT/JP2014/003170

§ 371 (c)(1),
(2) Date: Dec. 8, 2015

(87) PCT Pub. No.: WO2014/203509

PCT Pub. Date: Dec. 24, 2014

(65) Prior Publication Data

US 2016/0153062 A1 Jun. 2, 2016

(30) Foreign Application Priority Data

Jun. 19, 2013 (JP) ..... 2013-128653

(51) Int. Cl.
*F27D 19/00* (2006.01)
*C21C 5/46* (2006.01)
(Continued)

(52) U.S. Cl.
CPC ..... *C21C 5/4673* (2013.01); *C21B 7/163* (2013.01); *C21C 5/48* (2013.01); *F27D 19/00* (2013.01); *F27D 2019/0078* (2013.01)

(58) Field of Classification Search
CPC ..... C21B 7/24
(Continued)

(56) References Cited

U.S. PATENT DOCUMENTS 5,223,908 A * 6/1993 Scott ..... C21B 7/24 356/5.06
5,481,247 A * 1/1996 Alexander ..... C21B 7/24 266/267
9,799,110 B2 * 10/2017 Tsuda ..... C21B 7/24

FOREIGN PATENT DOCUMENTS

JP 47-38817 A 12/1972
JP 55-41904 3/1980
(Continued)

OTHER PUBLICATIONS

Chinese Office Action dated Aug. 25, 2016, of corresponding Chinese Application No. 201480034520.2, along with a Search Report in English.

(Continued)

*Primary Examiner* — Scott R Kastler
(74) *Attorney, Agent, or Firm* — RatnerPrestia

(57) ABSTRACT

A method of detecting an abnormality in a blast furnace, wherein the abnormality causes clogging of a tuyere unit of the blast furnace, the method including capturing an image of a raceway unit through an in-furnace monitor window disposed at the tuyere unit; and determining that the abnormality has occurred when a brightness of the captured image is lower than or equal to a predetermined brightness threshold and a rate of decrease in the brightness is lower than or equal to a predetermined brightness-decrease-rate threshold.

4 Claims, 12 Drawing Sheets

(51) Int. Cl.
*C21B 7/16* (2006.01)
*C21C 5/48* (2006.01)

(58) Field of Classification Search
USPC ..... 266/100, 267
See application file for complete search history.

(56) References Cited

FOREIGN PATENT DOCUMENTS

| | | | |
|---|---|---|---|
| JP | 58-96804 | A | 6/1983 |
| JP | 59-59813 | A | 4/1984 |
| JP | 60-125307 | A | 7/1985 |
| JP | 61-48508 | | 3/1986 |
| JP | 64-079310 | | 3/1989 |
| JP | 5-186811 | A | 7/1993 |
| KR | 10-1999-0042422 | | 6/1999 |
| WO | 89/07156 | | 8/1989 |

OTHER PUBLICATIONS

Supplementary European Search Report dated May 4, 2016, of corresponding European Application No. 14814308.4.
Korean Notice of Allowance dated Apr. 14, 2017, of corresponding Korean Application No. 9-5-2017-026610784 along with an English. translation.
Chinese Office Action dated Jun. 16, 2017, of corresponding Chinese Application No. 201480034520.2, along with a Concise Statement of Relevance of Office Action in English.
Chinese Office Action dated Feb. 6, 2018, of corresponding Chinese Application No. 201480034520.2, along with a Concise Statement of Relevance of Office Action in English.

* cited by examiner

METHOD OF DETECTING ABNORMALITY AT BLAST FURNACE AND METHOD OF OPERATING BLAST FURNACE

TECHNICAL FIELD

This disclosure relates to a method of detecting an abnormality at a blast furnace with which an abnormality occurring in a tuyere unit of a blast furnace is detected and a method of operating a blast furnace using the method to detect the abnormality.

BACKGROUND

Examples of an existing method of operating a blast furnace include a technology described in Japanese Unexamined Patent Application Publication No. 5-186811. The technology involves counting the frequency of falling of an unmelted ore at a tuyere unit from thereabove and adjusting the ratio of ore and coke in an area around the furnace top from which the ore and coke are charged so that the frequency is kept from exceeding a predetermined reference value. The number of times the unmelted ore falls is counted through a monitor using a camera disposed at the blast furnace tuyere unit as the frequency or number of times that the brightness decreases in an image is counted as the frequency.

The technology described in Japanese Unexamined Patent Application Publication No. 5-186811, however, is to detect falling of unmelted ore at the tuyere unit and not to detect an abnormality causing clogging of the tuyere due to a flow of slag, molten iron, or other objects. Moreover, since the above-described technology exclusively determines the decrease in brightness in an image, the technology cannot detect a sudden change in brightness as a result of clogging of the tuyere distinguishably from a gradual change in brightness due to a temperature change in the raceway unit.

Thus, it could be helpful to provide a method of detecting an abnormality at a blast furnace with which an abnormality causing clogging of a tuyere can be detected at an early stage and a method of operating a blast furnace using the method of detecting the abnormality.

SUMMARY

We thus provide:

a method of detecting an abnormality in a blast furnace, wherein the abnormality causes clogging of a tuyere unit of the blast furnace is detected, the method including capturing an image of a raceway unit through an in-furnace monitor window disposed at the tuyere unit; and determining that the abnormality has occurred when a brightness of the captured image is lower than or equal to a predetermined brightness threshold and a rate of decrease in the brightness is lower than or equal to a predetermined brightness-decrease-rate threshold;

the method wherein the abnormality is determined to have occurred when a state where the brightness of the captured image remains lower than or equal to the brightness threshold continues for a predetermined time period from when the brightness arrives at or falls below the brightness threshold and the rate of decrease in brightness arrives at or falls below the brightness-decrease-rate threshold;

the method wherein the rate of decrease in brightness is calculated using a least-square method on a basis of a plurality of past brightness data points;

the method wherein the brightness threshold is a value lower by a fixed ratio than a moving average of a plurality of past brightness data points, which is used as a reference; and a method of operating a blast furnace with the method including adjusting a rate of an air blast to the tuyere unit when an abnormality is detected.

Our methods enable exclusive detection of a sudden decrease in brightness as distinguished from a gradual decrease in brightness due to a temperature change in the raceway unit. Thus, an abnormality causing clogging of the tuyere can be accurately detected at an early stage.

In addition, the operation conditions are adjusted when the abnormality is determined to have occurred. Thus, a serious situation such as an ejection of in-furnace matter from the tuyere unit can be prevented. Thus, our methods are advantageous in terms of safety and equipment maintenance costs.

REFERENCE SIGNS LIST

Figure 1:
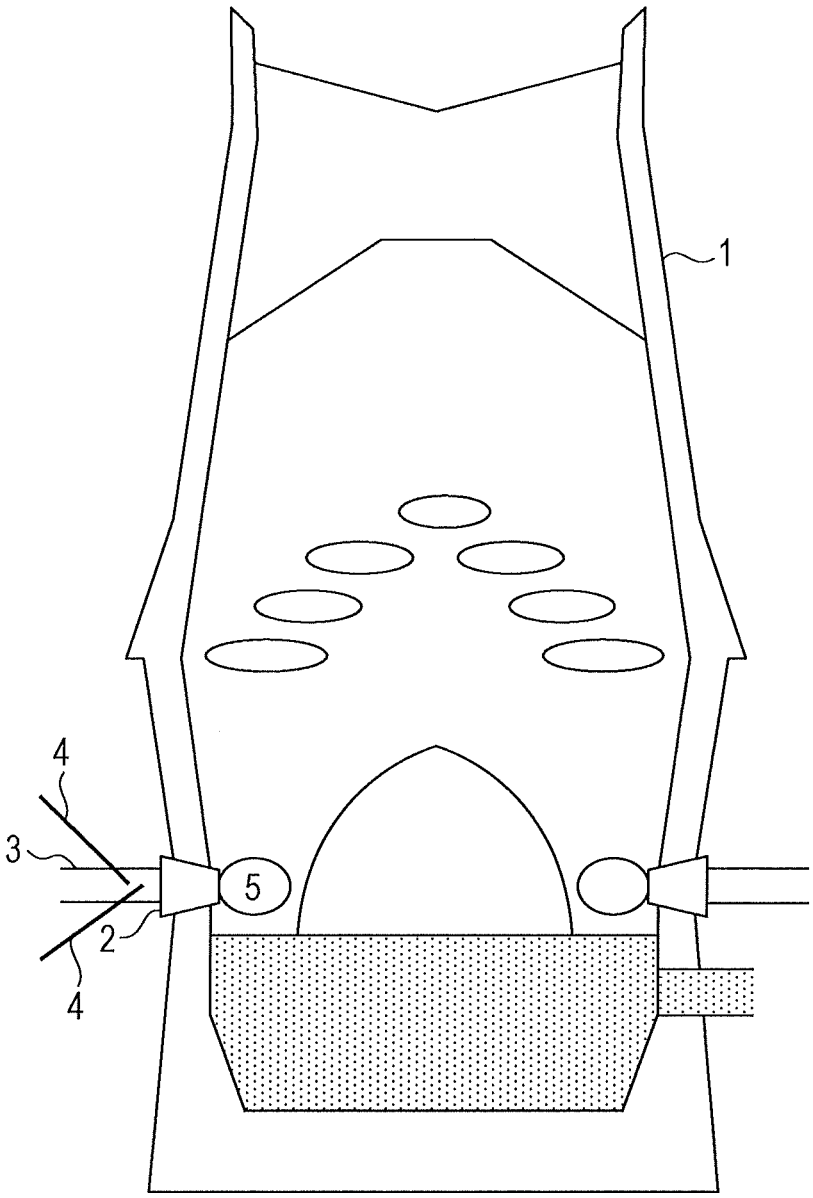
FIG. 1 is a diagram of the entirety of a blast furnace operated by our methods.

1 blast furnace
2 tuyere
3 blast pipe
4 lance
5 raceway
6 in-furnace monitor window
11 camera
12 abnormality detection unit
13 monitor
14 operation-condition adjusting unit

DETAILED DESCRIPTION

We provide a method of detecting an abnormality at a blast furnace, the method being with which the abnormality causing clogging of a tuyere unit of the blast furnace is detected, the method including the steps of: capturing an image of a raceway unit through an in-furnace monitor window disposed at the tuyere unit; and determining that the abnormality has occurred when the brightness of the captured image is lower than or equal to a predetermined brightness threshold and the rate of decrease in the brightness is lower than or equal to a predetermined brightness-decrease-rate threshold.

In this manner, the rate of decrease in brightness is also determined in addition to the decrease in brightness. Thus, abnormality determination is enabled while changes of brightness caused by gradual temperature changes in a raceway unit are distinguished from sudden changes of brightness at the time of clogging of the tuyere.

It is preferable to determine that an abnormality causing clogging of the tuyere unit has occurred when a state where the brightness of the captured image remains lower than or equal to the brightness threshold continues for a predetermined time length from when the brightness arrives at or falls below the brightness threshold and the rate of decrease in brightness arrives at or falls below the predetermined brightness-decrease-rate threshold.

The reason is that among phenomena in which an unmelted ore falls and adheres to a tuyere tip portion, a phenomenon in which an unmelted ore falls down from the tuyere tip portion in a short time period is temporary clogging of the tuyere and such a phenomenon may not have to be determined as an abnormality. Thus, temporary clogging of the tuyere is excluded from the target of abnormality detection and serious clogging can be exclusively detected.

It is preferable to calculate the rate of decrease in brightness using a least-square method on the basis of multiple past brightness data points.

With this method, an average rate of change in brightness is acquired. Thus, even when a change in brightness in a raceway unit between the current point and one previous sampling point is abrupt, an appropriate rate of change in brightness can be acquired without being affected by the fluctuation. Thus, it is possible to prevent excessive abnormality detection.

It is preferable to set the brightness threshold to be lower by a fixed ratio than the average of multiple past brightness data points, which is used as a reference.

Since the brightness threshold is set using the average of past brightness data as a reference, the decrease in brightness can be appropriately detected even when the brightness is generally low.

An aspect of the method of operating a blast furnace includes adjusting the rate of an air blast to the tuyere unit when an abnormality has been detected using any of the above-described methods of detecting an abnormality at a blast furnace.

In this manner, the operation conditions can be adjusted by, for example, increasing or decreasing the rate of an air blast to the tuyere when an abnormality causing clogging of the tuyere has been detected. Thus, an emergency action can be appropriately taken, whereby stable blast furnace operation can be performed.

Referring now to the drawings, an example of our method is described below.

Example 1

FIG. 1 is a drawing of the entirety of a blast furnace operated by a method of operating a blast furnace according to Example 1. As illustrated in FIG. 1, a blast pipe (blow pipe) 3 that blows hot air from an air-heating furnace to the furnace inside connects to the inner side of a tuyere 2 of a blast furnace 1. Through the blast pipe 3, lances 4 are disposed. From the lances 4, fuel such as pulverized coal, oxygen, or town gas is blown into the furnace inside.

A combustion space called a raceway 5 is formed in a coke accumulated layer to the front of the tuyere 2 in the direction in which hot air is blown. Mainly in this combustion space, coke burning and gasification (redox of iron ore, that is, pig iron production) are performed.

Figure 2:
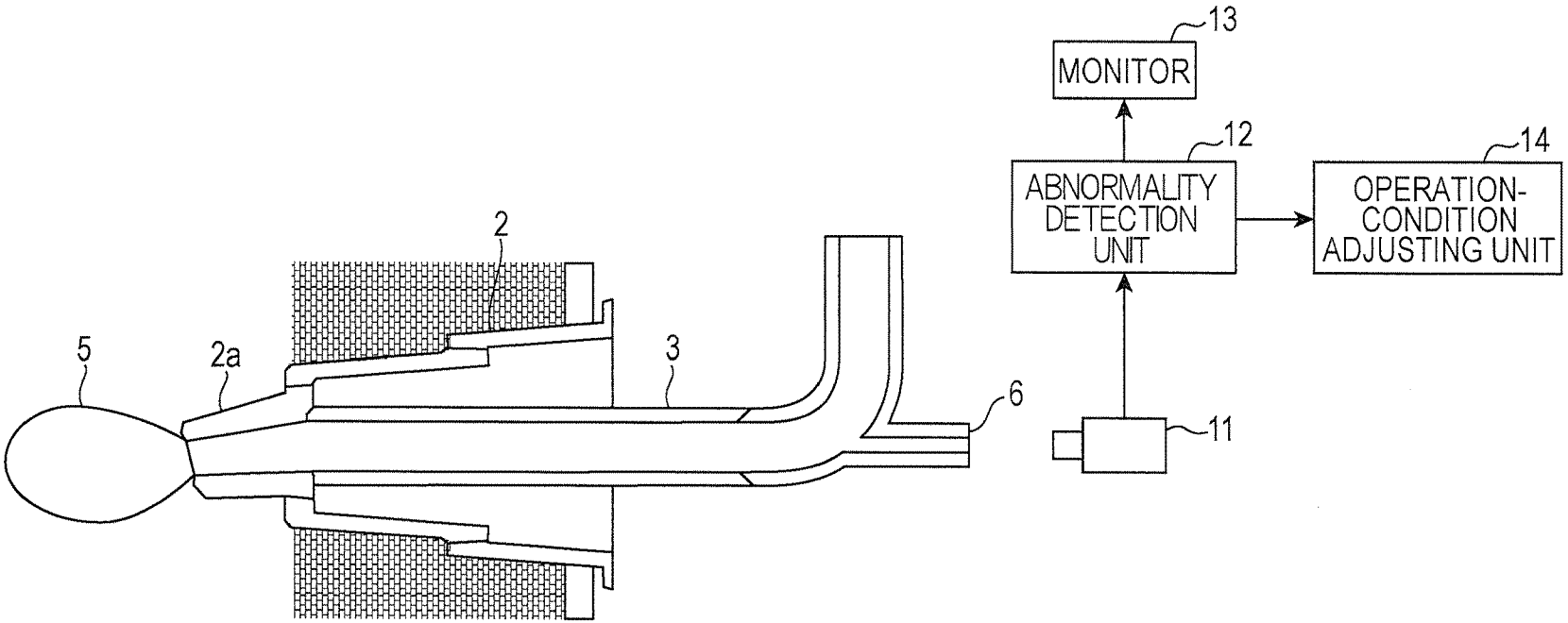
FIG. 2 illustrates a position at which a camera is disposed.

As illustrated in FIG. 2, an in-furnace monitor window 6 is formed in the tuyere unit so that an operator can monitor the furnace inside. Near the in-furnace monitor window 6, a camera 11 that captures an image of the raceway 5 through the in-furnace monitor window 6 is disposed.

Figure 3:
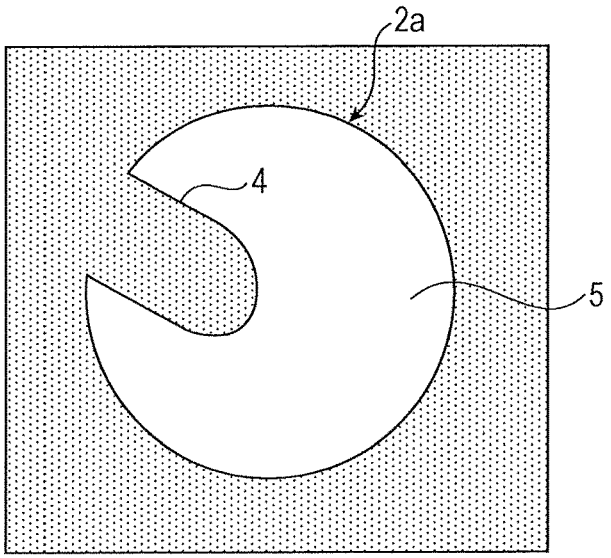
FIG. 3 illustrates an example of an image captured by the camera.

FIG. 3 illustrates an example of an image captured by the camera 11. As illustrated in FIG. 3, in the captured image, the raceway 5 and the silhouette of a lance 4 are imaged on the inner side of a circle corresponding to the opening at the tip of a small tuyere 2*a* constituting the tuyere 2.

The captured image of the raceway unit, captured by the camera 11, is input into an abnormality detection unit 12. The abnormality detection unit 12 detects an abnormality causing clogging of the tuyere 2 using the captured image, captured by the camera 11.

An unmelted ore falls as a result of a collapse of the raceway 5. At this time, clogging of a tuyere, in which part of the unmelted ore adheres to the tip of the tuyere 2 and the tuyere 2 is clogged, may be caused. This clogging of a tuyere can be caused as a result of an inflow of slag, molten iron, or the like. When the tuyere is clogged, the brightness in the captured image suddenly falls.

The abnormality detection unit 12 detects an abnormality causing clogging of the tuyere by monitoring a phenomenon of a sudden decrease in brightness in an image of the tuyere inside. The detection results from the abnormality detection unit 12 are displayed on a monitor 13 and notified to an operator.

The abnormality detection results from the abnormality detection unit 12 are also input to an operation-condition adjusting unit 14. When the abnormality detection unit 12 detects an abnormality causing clogging of the tuyere, the operation-condition adjusting unit 14 adjusts the conditions for the blast furnace operation, for example, increases or decreases the rate of hot air blown into the furnace inside.

Figure 4:
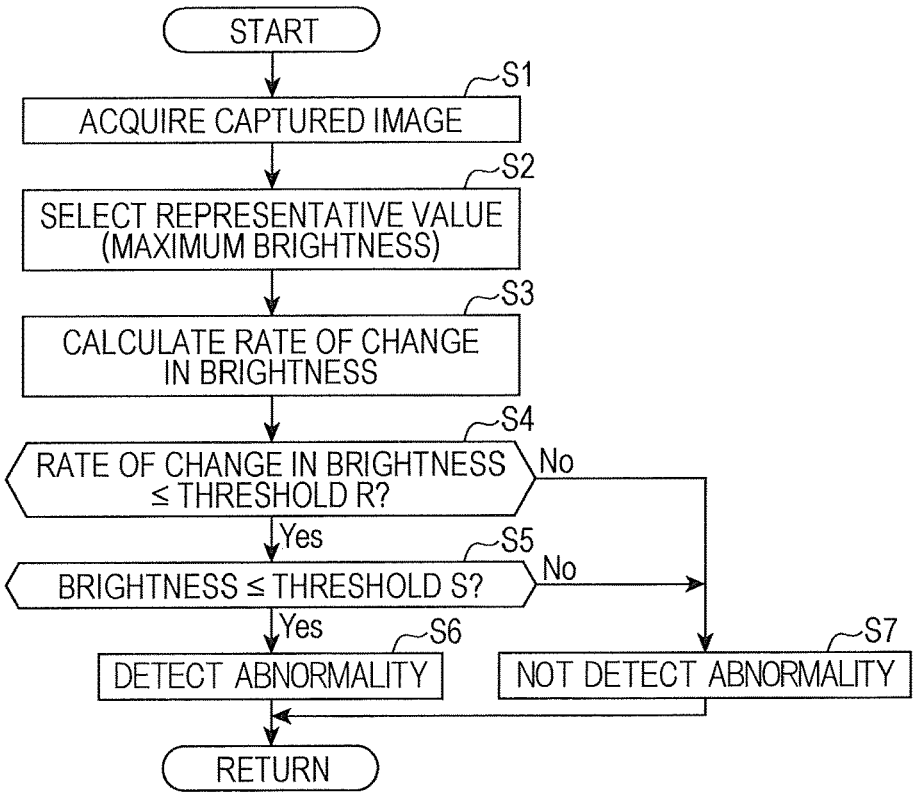
FIG. 4 is a flowchart of an abnormality detection process.

FIG. 4 is a flowchart illustrating the abnormality detection process performed by the abnormality detection unit 12. This abnormality detection process is cyclically performed at predetermined intervals. First, in Step S1, the abnormality detection unit 12 acquires a captured image, captured by the camera 11.

Subsequently in Step S2, the abnormality detection unit 12 selects the maximum brightness in the captured image (grayscale) acquired in Step S1 and this maximum brightness is used as a representative value of the brightness (representative brightness) in the image.

In Step S3, the abnormality detection unit 12 acquires the rate of change in representative brightness (the rate of change in brightness) using time-series data of the representative brightness selected in Step S2. A straight line is found by performing fitting with the least-square method using multiple past data points (M points) and the slope of the straight line is employed as the rate of change in brightness.

In Step S4, the abnormality detection unit 12 determines whether the rate of change in brightness calculated in Step S3 is lower than or equal to a predetermined threshold R.

The threshold R is a negative value, for example, set at −10. Specifically, the abnormality detection unit 12 determines whether the rate of decrease in brightness is lower than or equal to a predetermined brightness-decrease-rate threshold. When the abnormality detection unit 12 determines that the rate of change in brightness is lower than or equal to the threshold R, the process flows to Step S5.

In Step S5, the abnormality detection unit 12 determines whether the representative brightness (maximum brightness) selected in Step S2 is lower than or equal to a predetermined threshold (brightness threshold) S. The threshold S is set at a value lower than, for example, a past predetermined-time-length (for example, 10 minutes) moving average of the representative brightness (for example, a value acquired by multiplying a moving average by 0.7). When the abnormality detection unit 12 determines that the representative brightness is lower than or equal to the threshold S, the process flows to Step S6.

In Step S6, the abnormality detection unit 12 determines that an abnormality causing clogging of the tuyere has occurred (the abnormality is detected) and finishes the abnormality detection process.

On the other hand, when the abnormality detection unit 12 determines in Step S4 that the rate of change in brightness exceeds the threshold R or determines in Step S5 that the representative brightness exceeds the threshold S, the process flows to Step S7, where the abnormality detection unit 12 determines that an abnormality does not occur in the tuyere unit (an abnormality is undetected) and finishes the abnormality detection process.

Hereinbelow, the abnormality detection process in the tuyere unit is described using specific examples.

First, the abnormality detection unit 12 acquires the captured image of the raceway unit, captured by the camera 11 disposed at a specific tuyere 2 (Step S1 in FIG. 4), and then selects the maximum brightness in the captured image thus acquired (Step S2).

Figure 5:
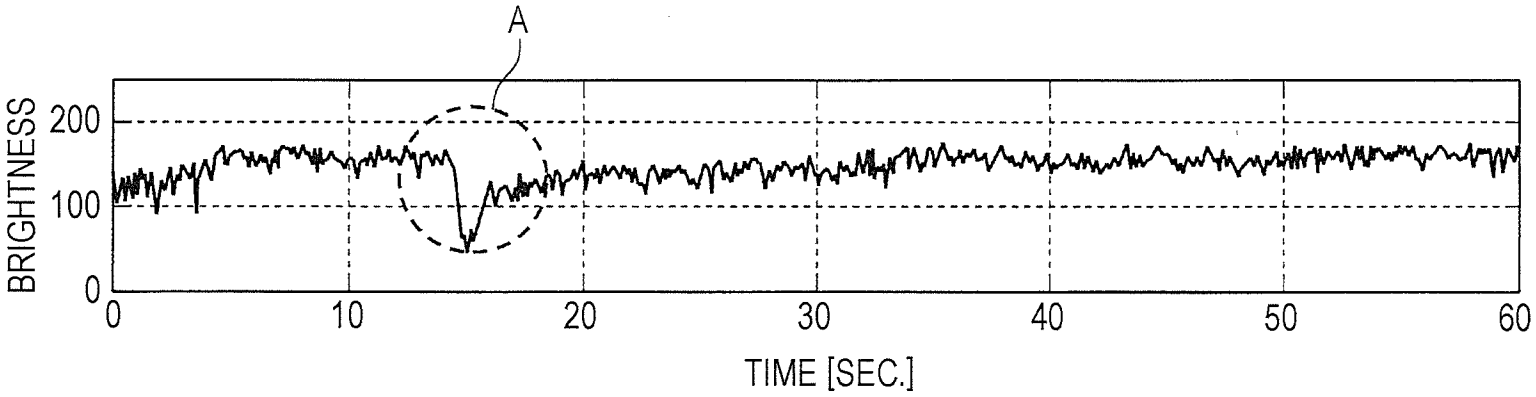
FIG. 5 illustrates the change in brightness during a time period including a phenomenon of an unmelted ore falling.

At this time, time-series data of the maximum brightness during a time period including a phenomenon of an unmelted ore falling is shown as in FIG. 5. Data in FIG. 5 is the maximum brightness data sampled at a 0.3-second cycle during a period of 60 seconds. The brightness is represented using 256 levels of gray between white and black for a grayscale image captured by the camera 11. As indicated in a portion encircled by a broken line A in FIG. 5, the brightness suddenly decreases at the time when an unmelted ore falls. Time-series data of the maximum brightness during a time period that does not include a phenomenon of an unmelted ore falling is shown as in FIG. 6, on the other hand. In the time period that does not include a phenomenon of an unmelted ore falling, the brightness in the image generally gradually changes due to factors such as the change in temperature in the raceway 5 or fogging of the glass that separates the furnace inside and the camera 11 from each other.

In this manner, even when an unmelted ore does not fall, a decrease in brightness occurs. Thus, if the abnormality causing clogging of the tuyere is to be determined by performing thresholding on only the decrease in brightness, a gradual decrease in brightness attributable to a change in temperature of the raceway unit would also be detected as an abnormality at the same time. This excessive detection hinders an accurate detection of a phenomenon of a decrease in brightness that leads to clogging of the tuyere 2. Thus, in this Example 1, the abnormality determination is performed by performing thresholding on not only a decrease in brightness but also a rate of change in brightness. Specifically, a phenomenon of a decrease in brightness that leads to clogging of the tuyere 2 is determined to have occurred only when the brightness decreases and the rate of decrease in brightness is low.

At this time, the slope of the straight line found by performing linear fitting with the least-square method using M points of past maximum brightness data is employed as the rate of change in brightness.

The easiest one of methods of acquiring the rate of change in brightness is a method of acquiring a difference between the current data and one previous past data point (one previous sampled data point). The symbol a in the lower plot in FIG. 7 denotes the result of the rate of change in brightness acquired by the method of taking a difference on the basis of the change in brightness in the upper plot in FIG. 7.

When the difference is used as the rate of change in brightness, a sudden change in brightness in each time period would result in a considerable fluctuation of the rate of change in brightness. Thus, as illustrated in a portion encircled with a symbol B, the change in brightness at an occurrence of a phenomenon of an unmelted ore falling encircled with the symbol A cannot be grasped. Specifically, using the difference as the rate of change in brightness would hinder exclusive detection of the target decrease in brightness.

Figure 7:
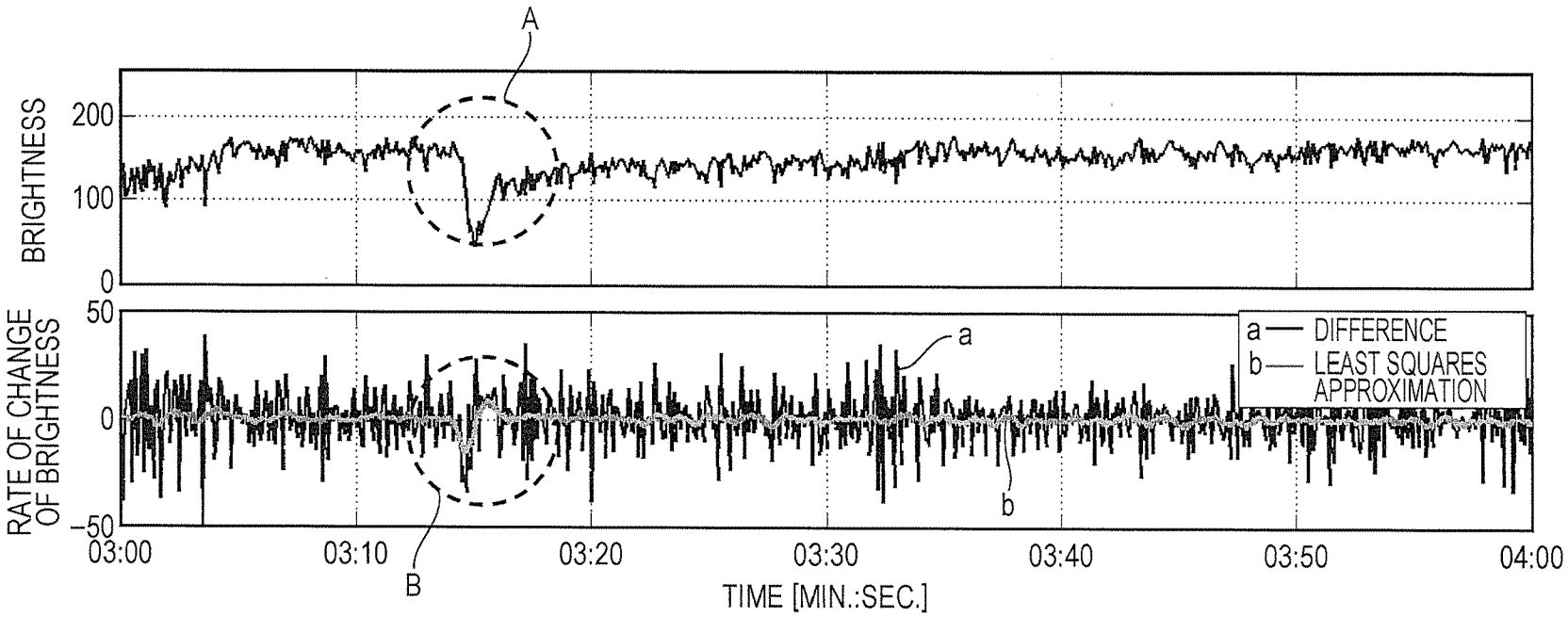
FIG. 7 illustrates the rate of change in brightness.

On the other hand, when the slope of the straight line found by performing linear fitting with the least-square method is used as the rate of change in brightness, the rate of change in brightness is shown as indicated with the symbol b in the lower plot of FIG. 7. In this case, the effect of fine changes in brightness occurring at a short cycle can be minimized. Thus, as illustrated in a portion encircled with the symbol B, the change in brightness at an occurrence of a phenomenon of an unmelted ore falling encircled with the symbol A can be accurately grasped.

The abnormality detection unit 12 performs thresholding on the representative brightness (maximum brightness) in the captured image and on the rate of change in brightness calculated by the least-square method. Then, when the abnormality detection unit 12 determines that the representative brightness and the rate of change in brightness are lower than or equal to the respective thresholds S and R (Yes in Step S4 and Yes in Step S5), the abnormality detection unit 12 determines that a sudden decrease in brightness that can cause clogging of the tuyere has occurred (Step S6).

The threshold S is set at a value that is lower by a fixed ratio than a moving average of multiple past brightness data points, which is used as a reference (for example, the threshold S is set at a value that is within a range from 30% to 70% of the moving average). The time-average brightness at the current time is determined by the temperature of the raceway unit. On the other hand, at an occurrence of clogging of the tuyere, the brightness decreases with respect to the current-time brightness. Thus, when the decrease in brightness is determined using a fixed threshold, a phenomenon of a decrease in brightness fails to be detected if the tuyere becomes clogged from the state having an average brightness lower than or equal to the threshold S. Thus, setting the threshold S as a dynamic value enables appropriate detection of a sudden decrease in brightness even when the brightness is generally low.

Figure 8:
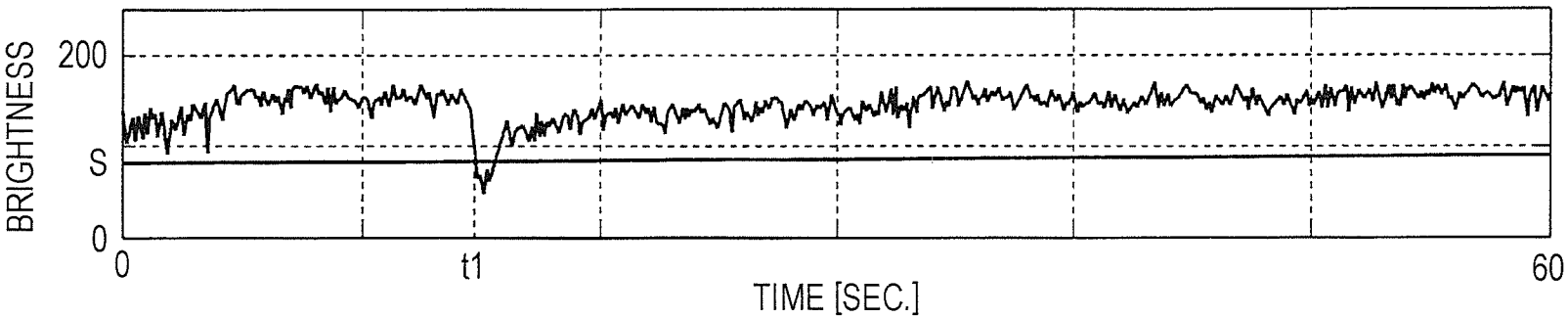
FIG. 8 illustrates the change in brightness and the brightness threshold during the time period including a phenomenon of an unmelted ore falling.
Figure 9:
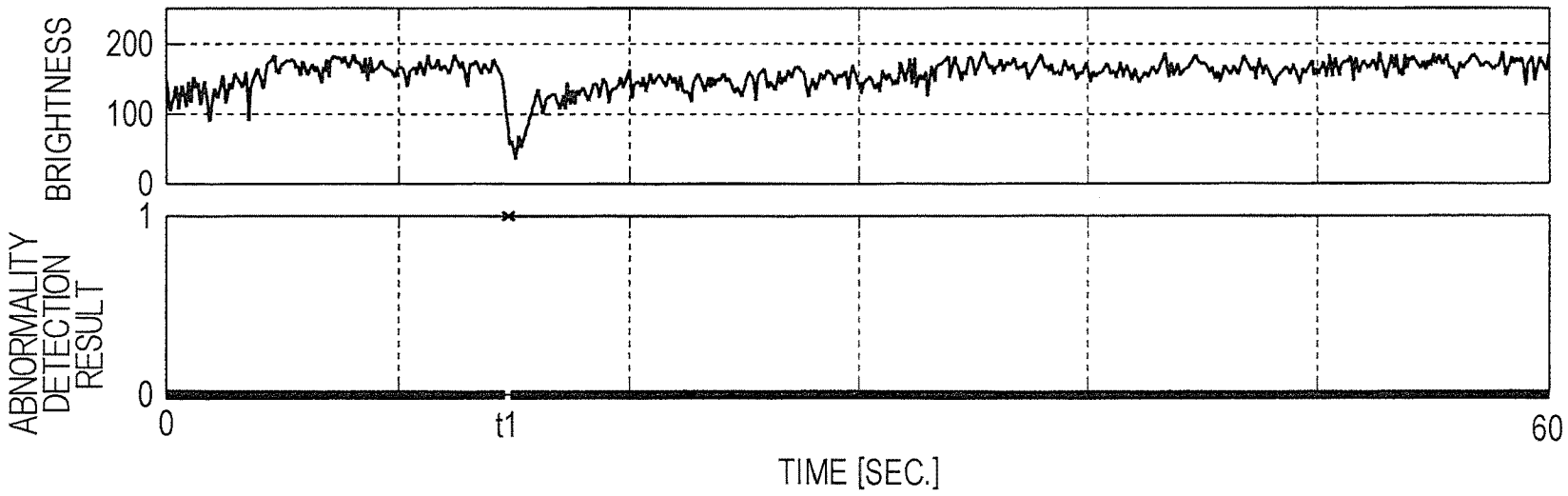
FIG. 9 illustrates the abnormality determination result during the time period including a phenomenon of an unmelted ore falling.

When the above-described abnormality determination is performed on the brightness data including a phenomenon of an unmelted ore falling illustrated in FIG. 5, the representative brightness arrives at or falls below the threshold S at the time t1 in FIG. 8 and the rate of change in brightness also arrives at or falls below the threshold R at that time. Thus, in this case, it is determined that an abnormality is detected (=1) at the time t1, as illustrated in FIG. 9.

Figure 6:
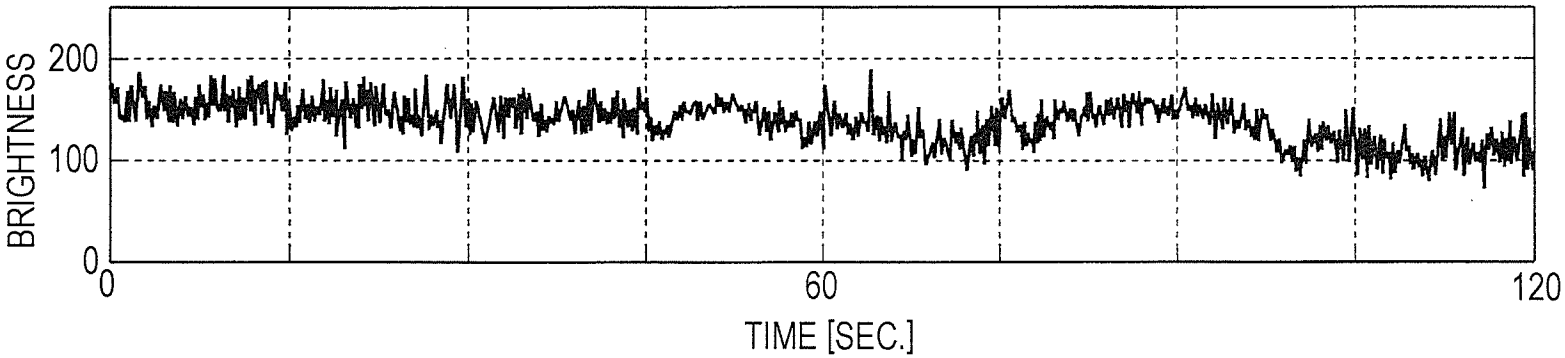
FIG. 6 illustrates the change in brightness during a time period that does not include a phenomenon of an unmelted ore falling.
Figure 10:
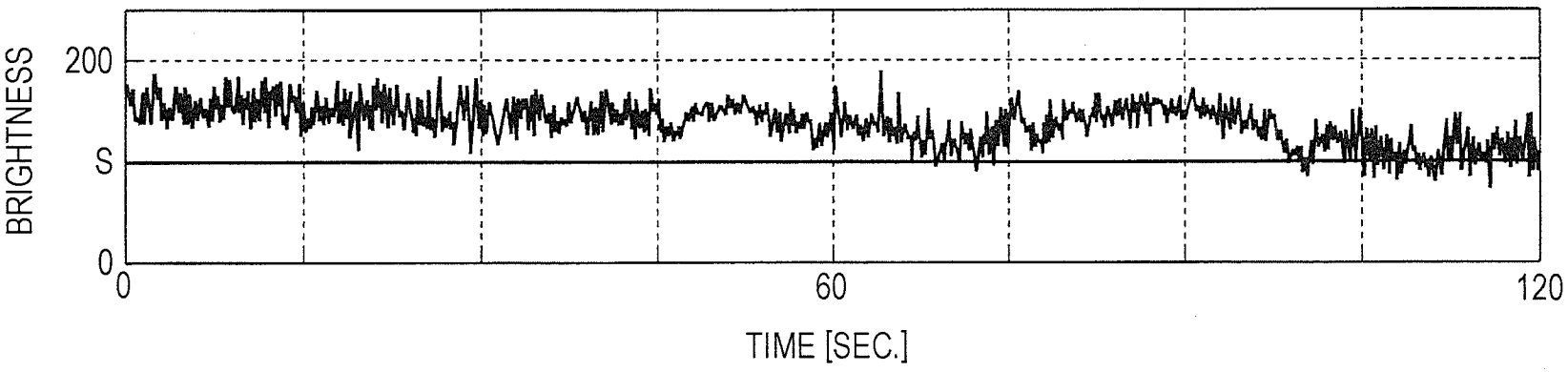
FIG. 10 illustrates the change in brightness and the brightness threshold during the time period that does not include a phenomenon of an unmelted ore falling.
Figure 11:
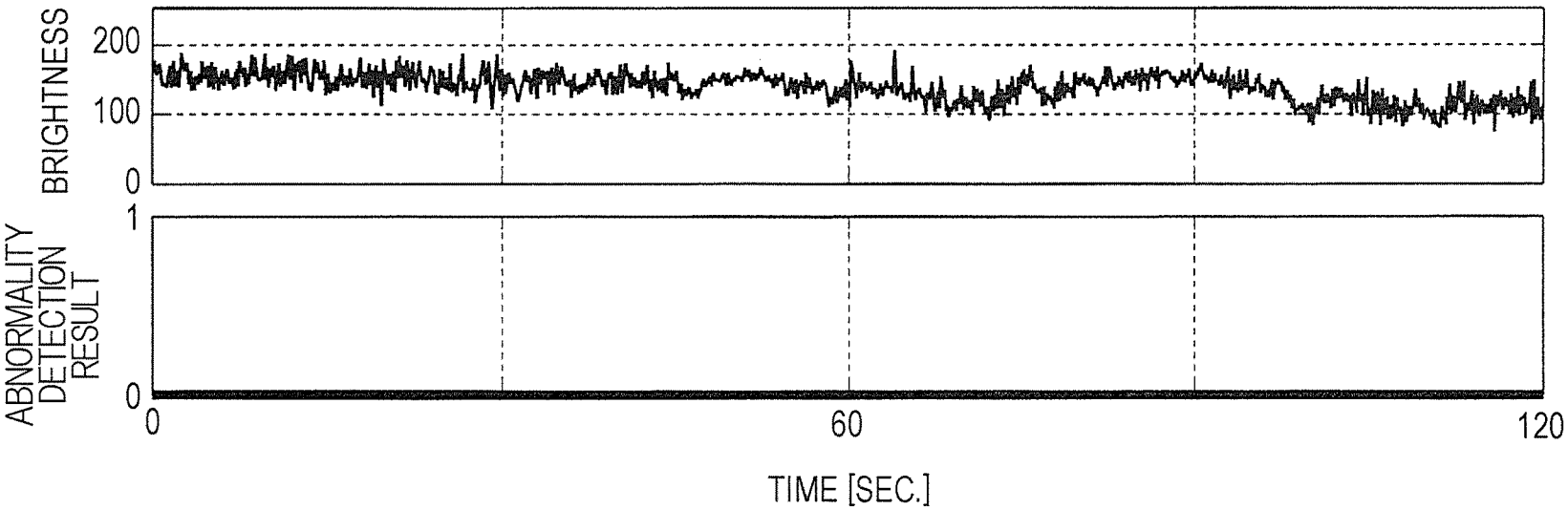
FIG. 11 illustrates the abnormality determination result during the time period that does not include a phenomenon of an unmelted ore falling.

On the other hand, when the abnormality determination is performed on the brightness data that does not include a phenomenon of an unmelted ore falling illustrated in FIG. 6, the representative brightness may arrive at or fall below the threshold S in accordance with the change in temperature of the raceway unit, as illustrated in FIG. 10. However, the rate of change in brightness does not arrive at or fall below the threshold R. Thus, as illustrated in FIG. 11, it is determined that an abnormality is undetected (=0).

As described above, in this Example 1, an image of the raceway unit is captured by the camera 11 and thresholding is performed on the brightness and the rate of change in brightness in the captured image. Thus, the abnormality determination can be performed while a change in brightness due to a gradual change in temperature in the raceway unit is distinguished from a sudden change in brightness at an occurrence of clogging of the tuyere.

At this time, a straight line is found by performing fitting with the least-square method using M points of past brightness data and the slope of the straight line is employed as the rate of change in brightness. Thus, the data is averaged, whereby a stable rate of change in brightness appropriate for thresholding can be acquired.

For the thresholding performed on the brightness, a value that is a certain rate of the average brightness of the past brightness data is set as a threshold. Dynamically setting the threshold in this manner enables an enhancement of the accuracy in abnormality determination.

Furthermore, since the maximum brightness in the captured image is used as the representative brightness and the thresholding is performed using the representative brightness, the signal processing can be accelerated. The area of the opening at the tip of the small tuyere 2*a* in the captured image changes depending on factors such as the individual difference between tuyeres or the state of installation of the camera 11. Thus, for example, the average brightness in the captured image is inappropriate for the representative brightness as it is largely affected by the black part in the silhouette. However, using the representative brightness as the maximum brightness in the captured image, as in Example 1, allows appropriate monitoring of the change in brightness in the image.

When an abnormality causing clogging of the tuyere has been detected, the operation conditions can be adjusted by, for example, increasing the rate of a hot air blast to remove an unmelted ore or other objects adhering to the tuyere tip or by decreasing the rate of a hot air blast to secure safety.

In this manner, a phenomenon of clogging of the tuyere can be detected at an early stage and an emergency action can be appropriately taken. Thus, a serious accident such as an ejection of in-furnace matter from the tuyere unit can be prevented, whereby our methods are effective in terms of safety and equipment maintenance costs.

Example 2

Subsequently, Example 2 is described.

In Example 2, the abnormality determination involves the use of the duration of a decrease in brightness as an evaluation item.

Figure 12:
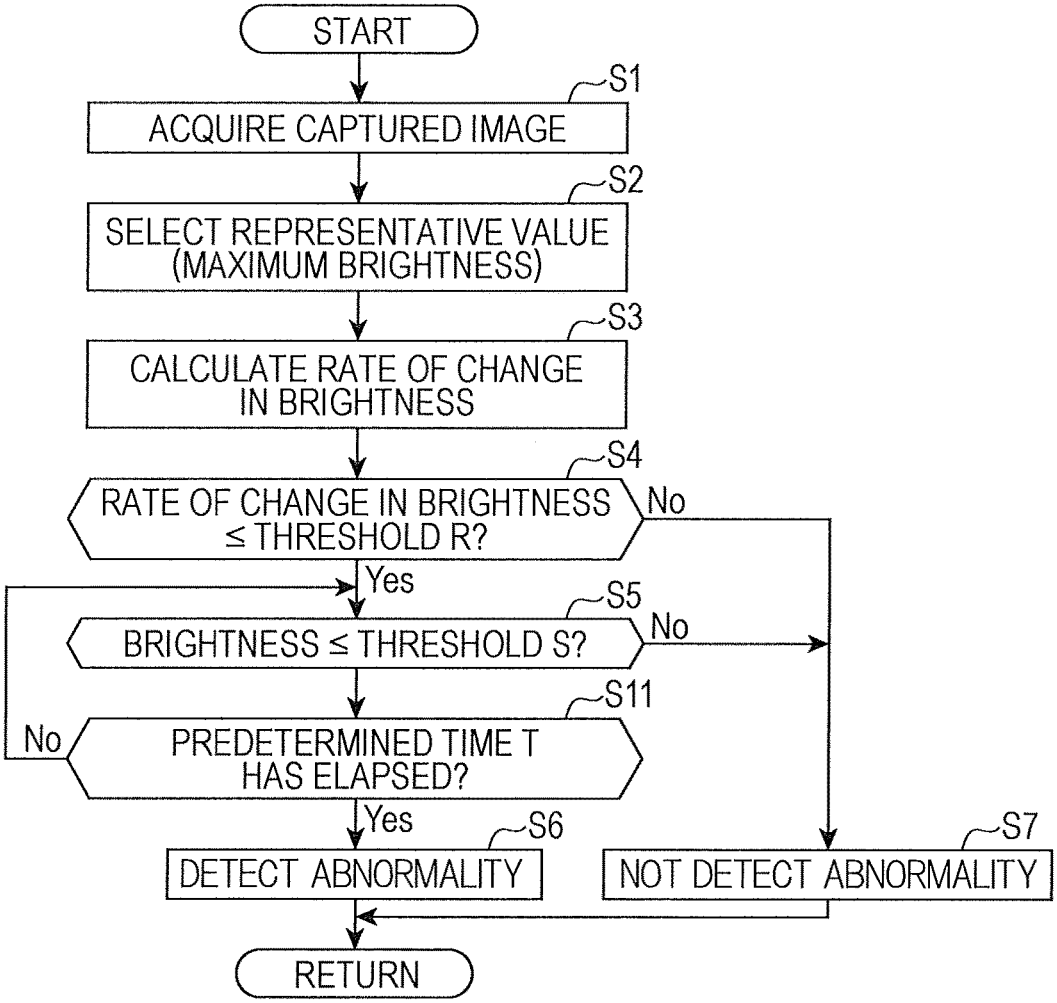
FIG. 12 is a flowchart of an abnormality detection process according to Example 2.

FIG. 12 is a flowchart of an abnormality detection process according to Example 2 performed by the abnormality detection unit 12. This abnormality detection process is similar to the abnormality detection process illustrated in FIG. 4 except that it additionally includes Step S11. Thus, the different point in the process is mainly described here.

In Step S11, the abnormality detection unit 12 determines whether the state where the brightness remains lower than or equal to the threshold S continues for a predetermined time period T. The predetermined duration T is set at a duration that allows an action in the blast furnace operation to be changed after an abnormality is detected and within a range of approximately several seconds to ten minutes. The predetermined duration T is set at, for example, ten seconds.

When the abnormality detection unit 12 determines that the state where the brightness remains lower than or equal to the threshold S is shorter than the predetermined duration T, the process flows to Step S5. When the abnormality detection unit 12 determines that the state where the brightness remains lower than or equal to the threshold S has arrived at the predetermined duration T, the process flows to Step S6.

Figure 13:
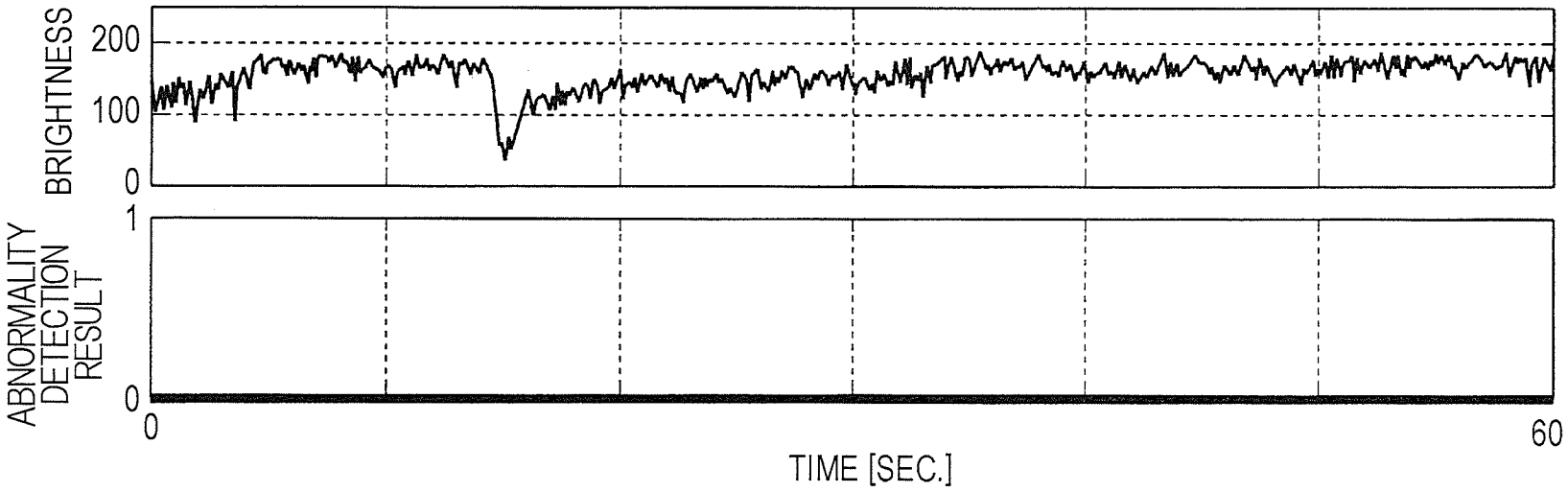
FIG. 13 illustrates the abnormality determination result during a time period including a phenomenon of an unmelted ore falling according to Example 2.

Thus, for example, when the tuyere is temporarily clogged due to an unmelted ore falling, the abnormality detection unit 12 determines that an abnormality causing clogging of the tuyere has not occurred since the unmelted ore comes off the tuyere unit and the brightness exceeds the threshold S before the predetermined duration T elapses from the time t1 in FIG. 8, at which time the brightness arrives at or falls below the threshold S and the rate of change in brightness arrives at or falls below the threshold R. Specifically, as illustrated in FIG. 13, the abnormality determination result shows no detection of an abnormality (=0), whereby a phenomenon of an unmelted ore falling within a short time period can be excluded from the target of abnormality detection.

A phenomenon of an unmelted ore falling can also cause clogging of a tuyere if the unmelted ore keeps adhering to the tip of the small tuyere 2*a* for a long time period. In normal falling of an unmelted ore, however, the unmelted ore falls down in a short time period and thus such normal falling may be usually excluded from the target of abnormality detection. When the tuyere is definitely clogged can be exclusively detected by exclusively determining, as an abnormality, when the state where the brightness remains lower than or equal to the threshold S continues for the predetermined duration T from when the brightness and the rate of change in brightness arrive at or fall below the respective thresholds S and R.

Excluding the phenomenon of an unmelted ore falling within a short time period, which is less likely to contribute to a serious accident, from the determination prevents excessive detection, whereby the operation costs can be minimized without the need for taking an unnecessary operating action.

Modified Example

The above-described Example 2 illustrates when the rate of change in brightness is calculated using the least-square method. However, other methods with which an average rate of change in brightness can be acquired can be used, instead.

The invention claimed is:

1. A method of operating a blast furnace, the method comprising:

capturing an image of a raceway unit by a camera through an in-furnace monitor window disposed at the tuyere unit;

determining that an abnormality has occurred when a brightness of the captured image is lower than or equal to a predetermined brightness threshold and a rate of decrease in the brightness is lower than or equal to a predetermined brightness-decrease-rate threshold, wherein the abnormality causes clogging of a tuyere unit of the blast furnace; and adjusting a rate of an air blast to the tuyere unit when the abnormality is detected.

2. The method according to claim 1, wherein the abnormality is determined to have occurred when a state where the brightness of the captured image remains lower than or equal to the brightness threshold continues for a predetermined time period from when the brightness arrives at or falls below the brightness threshold and the rate of decrease in brightness arrives at or falls below the brightness-decrease-rate threshold.

3. The method according to claim 1, wherein the rate of decrease in brightness is calculated using a least-square method on a basis of a plurality of past brightness data points.

4. The method according to claim 1, wherein the predetermined brightness threshold is a value that is within a range from 30% to 70% of a moving average of a plurality of past brightness data points, which is used as a reference.

* * * * *